United States Patent [19]

Delet

[11] 3,998,231

[45] Dec. 21, 1976

[54] BACKLESS BRASSIERE

[76] Inventor: Victoria Delet, 38 Peacock Dr., Roslyn, N.Y. 11576

[22] Filed: Aug. 22, 1975

[21] Appl. No.: 606,879

[52] U.S. Cl. ..... 128/476; 128/483; 128/510

[51] Int. Cl.[2] ..... A41C 1/20

[58] Field of Search ..... 128/425, 465, 469, 472, 128/473, 476, 477, 483, 488, 496, 498, 510

[56] References Cited

UNITED STATES PATENTS

| | | | |
|---|---|---|---|
| 858,867 | 7/1907 | Gaylord | 128/465 |
| 2,440,922 | 5/1948 | Algon | 128/425 |
| 2,864,375 | 12/1958 | Steinmetz | 128/510 X |
| 3,109,431 | 11/1963 | Jefferson | 128/472 |
| 3,216,425 | 11/1965 | De Keersmaecker | 128/425 |
| 3,396,728 | 8/1968 | Sachs et al. | 128/483 X |
| 3,605,753 | 9/1971 | Schwartz | 128/476 |
| 3,763,865 | 10/1973 | DeFru | 128/465 |

FOREIGN PATENTS OR APPLICATIONS

| | | | |
|---|---|---|---|
| 548,177 | 10/1922 | France | 128/469 |
| 1,043,400 | 6/1953 | France | 128/477 |

*Primary Examiner*—Werner H. Schroeder
*Assistant Examiner*—Moshe I. Cohen
*Attorney, Agent, or Firm*—Amster & Rothstein

[57] ABSTRACT

A backless brassiere incorporates underwires, each having a section extending outwardly from the lower portion of the bust cup to a position under the wearer's arm. Support straps run from the extending section of the underwire over the wearer's shoulder to the bust cup.

5 Claims, 6 Drawing Figures

BACKLESS BRASSIERE

This invention relates generally to brassieres and more specifically to a new backless brassiere design.

In the manufacture of brassieres, it is frequently desirable to construct a brassiere with a support arrangement which does not include straps or other support structure across the wearer's back so as to permit the wearing of backless fashions. To this end, backless brassiere arrangements have been designed which include relatively cumbersome support systems extending around the wearer's midriff or complicated strap arrangements designed to cross the wearer's back below the level of most backless fashions. However, these arrangements are cumbersome and uncomfortable and are not truly backless in that they usually include some portion of support across the wearer's lower back.

It has also been suggested, for example, in U.S. Pat. No. 3,216,425 that shoulder straps be used. While this system permits the back to be free of support structure, systems of this sort do not provide adequate support for the wearer.

Accordingly, it is the object of the present invention to provide a brassiere construction providing improved support without cumbersome strap arrangements. A related object of the invention is to provide a brassiere construction which gives good support without the need of support structure across the wearer's back.

In accomplishing these and other objects in accordance with the present invention, a brassiere is constructed with a pair of bust cups secured togehter adjacent their inner edges, each cup having an underwire secured to the lower portion thereof with the underwires extending outwardly from the bust cups to a position beneath the wearer's arm. Support straps extend from the upper portion of each cup, over the wearer's shoulder to a point adjacent the end of each outwardly extending portion of the underwire.

Other objects and features and advantages of the present invention will be more fully appreciated by reference to the following detailed description of a presently preferred embodiment of the present invention when taken in conjunction with the appendent drawings wherein.

Figure 1:
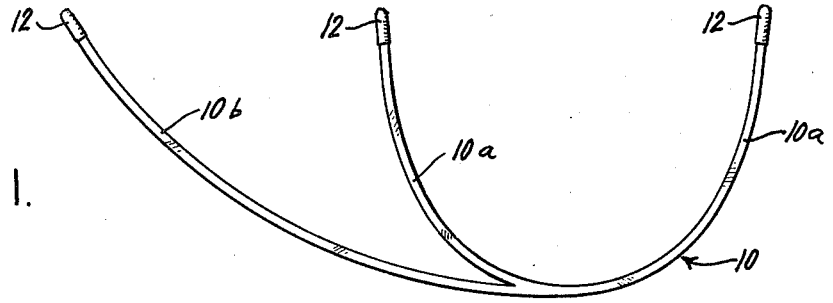
FIG. 1 is a front view of an underwire in accordance with applicant's invention.

Referring to the drawings, FIG. 1 shows a preferred construction of the semi-rigid underwire 10 of applicant's brassiere including a U-shaped section **10*a* adapted to be fixed beneath the bust cup and an extending section 10*b* extending laterally outward from the lower portion of the U-shaped section. By semi-rigid it is meant that the underwire is relatively more rigid than the flexible fabric and elastic materials used in the brassiere, but is still capable of flexing to some degree for proper functioning of the brassiere. In the preferred embodiment, underwire 10 is made of flat spring metal of a type which is known in the art. If flat, the underwire is more easily flexed in the direction perpendicular to the plane of the underwire than in the plate of the underwire. However, it is to be understood that it is within the contemplation of the applicant's invention that underwire 10** may be of plastic or any other suitable material.

When a metal element is used, it has been found desirable to fix plastic tip guards 12 to the free ends of the wire so as to cover sharp edges for safety.

Figure 2:
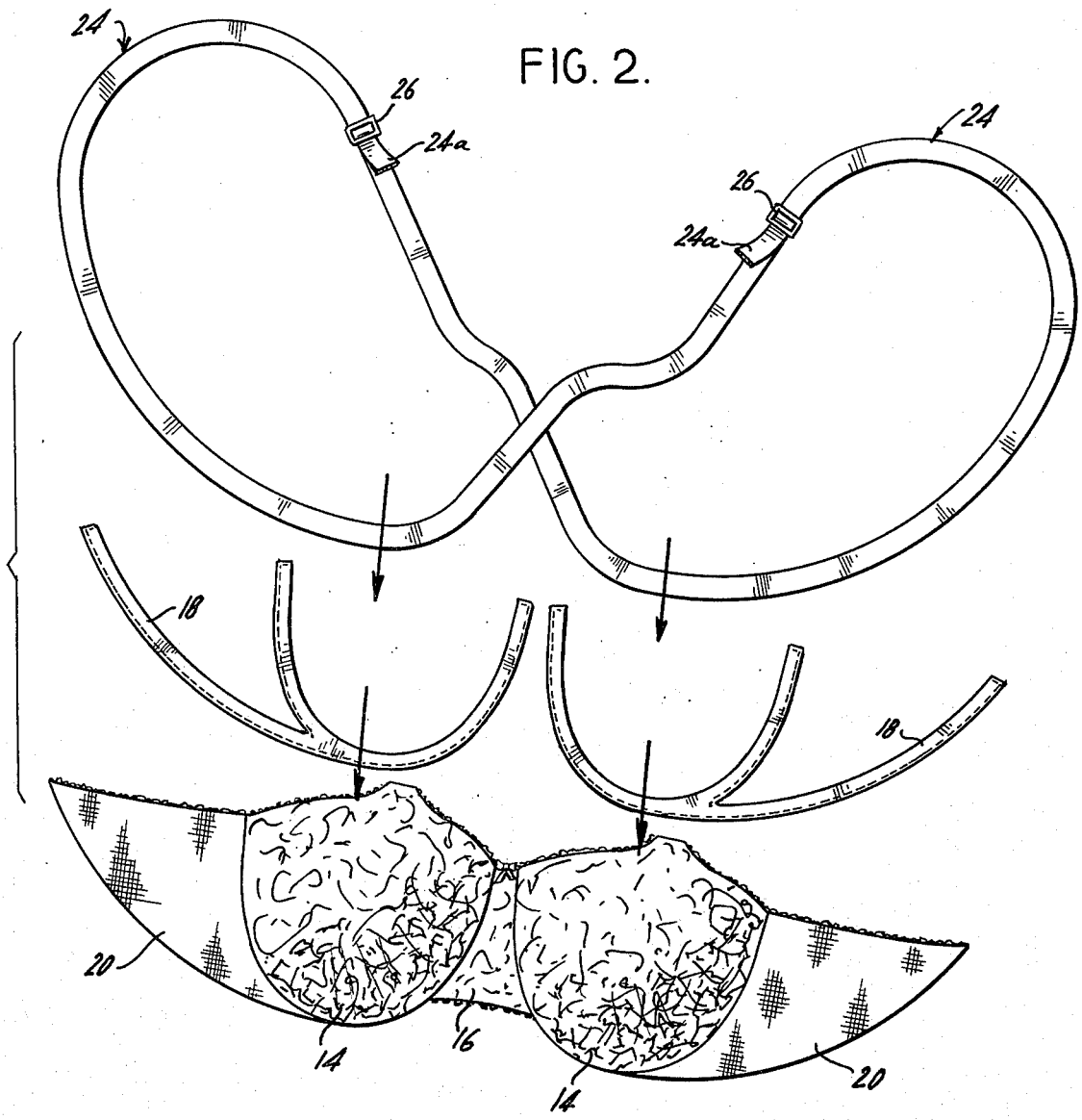
FIG. 2 is an exploded view of the principal components of one embodiment of applicant's invention.

The exploded view of FIG. 2 shows a presently preferred embodiment of the invention. This construction includes a pair of fabric bust cups 14 secured together along their interior edge by an attachment panel 16. The sewing details of cups 14 and panel 16 are not shown since a variety of stitching arrangements well-known in the art can be used. For example, center panel 16 may include a strengthening band sewn adjacent its lower edge and cups 14 may include similar strengthening bands, for example, across the upper edge of the cup. In addition, various constructions of the cup itself are possible as known in the art including strengthening inserts sewn into the cup, seams in the cup, etc. It is within the contemplation of applicant's invention that various known cup constructions may be used in applicant's invention.

Figure 3:
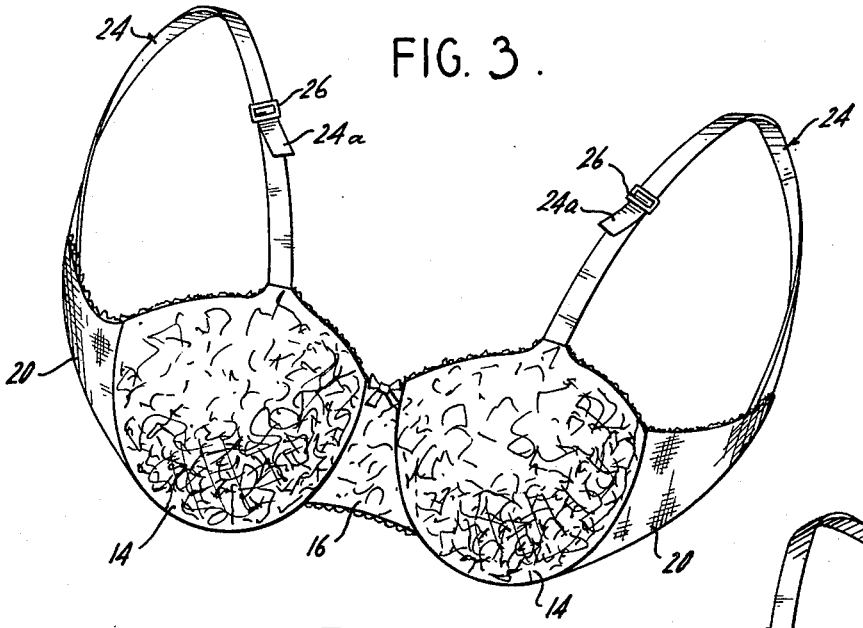
FIG. 3 is a prospective view of the completed brassiere construction of FIG. 2, showing the brassiere exterior.
Figure 4:
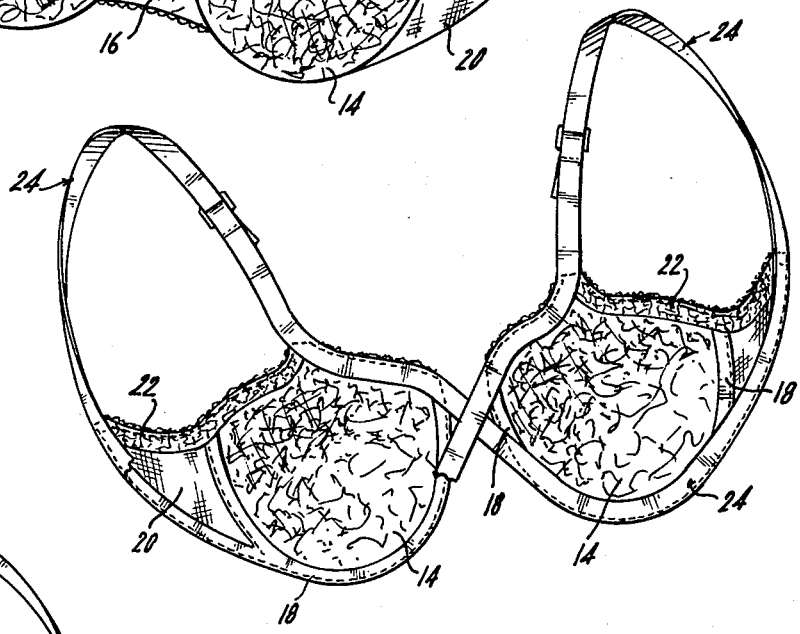
FIG. 4 is a prospective view of the brassiere construction of FIGS. 2 and 3, partially broken away showing the brassiere interior without the center panel between the cups.

In the embodiment shown in FIGS. 2, 3 and 4, the underwire of FIG. 1 is enclosed in a fabric sleeve 18 which is intended to cushion the contact between underwire 10 and the wearer's body and simultaneously facilitates the underwire being sewn in position as shown in FIG. 4. The sleeve may be formed in a variety of fashions; for example, two fabric sections conforming to the shape of underwire 10 may be cut, one placed over and one placed under the underwire and a row of stitches inserted on opposite sides of the underwire connecting the upper and lower fabric sections along substantially their entire length. Other methods of covering the wire portion will be apparent to those skilled in the art.

In the embodiment shown in FIGS. 2, 3 and 4, the space between the U-shaped portion 10a of the underwire and the extending section 10b is enclosed by stretchable fabric panels 20 sewn to the exterior edge of cups 14. These panels may include a strengthening band of elastic material 22 sewn adjacent its upper edge with elastic band 22 extending (as shown in FIG. 4) across a portion of the upper edge of the cups 14. It is to be understood that, if desired, the elastic panel 20 and the strengthening elastic strip 22 may be eliminated.

The brassiere of FIGS. 2, 3 and 4 is secured to the body by straps 24 which are secured (as shown in FIG. 4) to cross at the center of connecting panel 16 and extend beneath each cup along the U-shaped portion of underwire 10, and outwardly at the lower edges of panels 20 along the extending section **10*b*. When worn, the strap extends from the end of extending section 10*b* under the wearer's arm, over the wearer's shoulder meeting the bust cups at a central portion the upper edge of the cups. Straps 24 are preferrably of an elastic material and preferrably are broken at points 24*a* above the strap's attachment to the upper portion of each cup, with an adjustable slide 26 provided so that the length of the strap from the top of the cups 14 to the edge of panels 20** can be adjusted to fit the particular wearer.

It is to be understood that, as shown in FIG. 4, panel 16 can be eliminated with the securement between cups 14 being provided essentially by the cross-strap 24.

In one preferred construction, the bust cup 14, the overlaid underwire 10 enclosed in the fabric sheath 18 and the overlaid portion of strap 24 are stitched together along the lower edge of cups 14 and panels 20 on the under side of underwire 10. However, it is to be understood that various details of stitching construction are possible within the contemplation of applicant's invention and will be apparent to those skilled in the art.

As shown in FIGS. 2, 3 and 4, the contour of the upper portion of cups 14 may be shaped to extend upwardly slightly in the central region of each cup where it meets strap 24.

Figure 5:
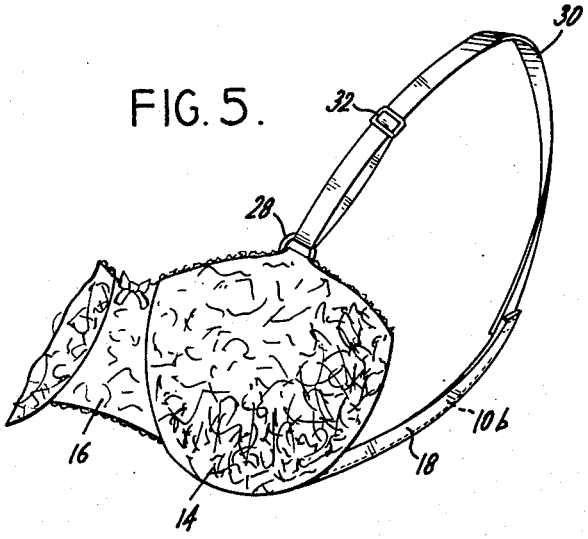
FIG. 5 is a partial respective view of the extension of a second embodiment of applicant's invention.

FIG. 5 shows an alternate embodiment of the invention including a pair of bust cups 14 and a central panel 16 (which may be identical to those used in the embodiment of FIGS. 2–4) with underwire 10 in fabric sheet 18 being sewn into the cup in a manner similar to that described in connection with FIGS. 2–4. The brassiere shown in FIG. 5 does not include elastic panels 20 or elastic straps 22 between the outer edge of cups 14 and extending section **10*b*. However, it is to be understood that a panel similar to panel 20 and/or straps similar to straps 22 may be incorporated in the embodiment of FIG. 5 just as these elements may be removed in the embodiment of FIGS. 2–4**.

In accordance with FIG. 5, a ring 28 is sewn into the upper central portion of cup 14 and a strap 30 is attached from a point adjacent the end of the extending section **10*b* through ring 28 to a slide member 32** which permits adjustment of the strap lengths.

It is further to be understood that FIG. 5 (and FIG. 6) show only a portion of the brassiere in accordance with the embodiments shown and that the cup and strap arrangement, etc. are repeated on the other portion of the brassiere which is not shown.

Figure 6:
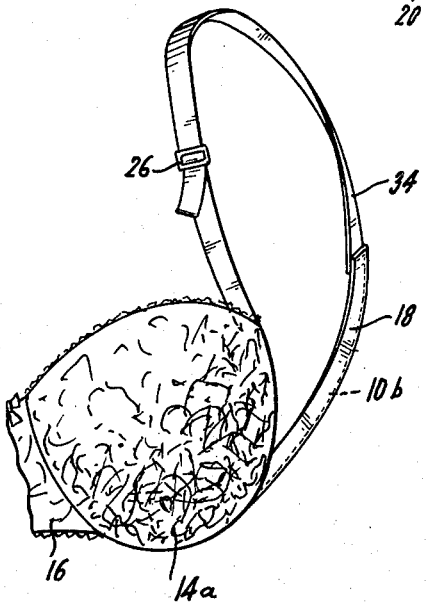
FIG. 6 is a partial prospective view of the exterior of a third embodiment of applicant's invention.

FIG. 6 shows a third alternate embodiment of the present invention which agains incorporates a cup **14*a*, a central panel 16 and the applicant's underwire element 10 enclosed in a fabric sheaf 18 as previously described. Cup 14*a* differs from cups 14 in that the upper edge of cup 14a comprises a smooth arcuate contour whereas the upper edge of cups 14 include an extending central portion adapted to receive the straps 24 (in FIGS. 2–4) and 30 (in FIG. 5). In the embodiment of FIG. 6, an elastic strap 34 extends from the outer end of extending section 10*b* (covered with fabric sheaf 18) to a point at the outer edge of the upper portion of cup 14*a* at one end of the U-shaped underwire portion. Strap 34 again includes a slide element 26** rendering the length of the elastic strap adjustable for the particular user.

Note that as shown, the embodiment of FIG. 6 (like FIG. 5) does not include an elastic side panel such as panel 20 in the embodiment of FIGS. 2–4. However, it is to be understood that a panel such as 20 in FIGS. 2–4 may be incorporated in the embodiment of FIG. 6 as well as a strengthening elastic band such as band 22 in FIGS. 2–4.

It is also to be understood that applicant's novel brassiere construction can be used in conjunction with other strap arrangements known in the art as well as others which will be apparent to those skilled in the art. In addition, the straps used may be non-elastic or part elastic as appropriate. Also, adhesive sections or tabs may be used to permit securement of the brassiere without straps which completely encircle the shoulder.

In each of the embodiments described above, the outward extension **10*b* of underwire 10, when the brassiere is worn, tends to extend around the side of the chest under the wearer's arm and is secured in this position by the strap arrangement for example, strap 24 in FIGS. 2–4. Underwire 10 and the construction described herein provides excellent support without the necessity of extensive straps across the wearer's back. However, it is to be understood that with other bust cup constructions and materials the shape of the underwire 10 may vary, the principal feature of the underwire being the outward extension 10*b***.

The above description relates to several embodiments of the present invention. Additional embodiments will be immediately apparent to those skilled in the art without departing from the spirit or scope of applicant's invention as defined in the following claims.

What is claimed is:

1. A brassiere comprising a pair of bust cups, said bust cups being secured together adjacent their inner edge, a semi-rigid U-shaped underwire section secured along the lower portion of each of said bust cups and having an arcuate extension extending outwardly from the lower portion thereof, and strap means secured between a point adjacent the end of each said arcuate extension away from said bust cup and said bust cup so that, in use, said arcuate extension extends under the wearer's arm to provide support for the bust.

2. Apparatus in accordance with claim 1 wherein said strap means extend from the end of said arcuate extension to a point adjacent an upper edge of said U-shaped underwire section.

3. A brassiere in accordance with claim 1 wherein said strap means is at least partially elastic.

4. A brassiere in accordance with claim 1 wherein the length of said strap means is adjustable.

5. A brassiere in accordance with claim 1 wherein each cup is provided with a securing ring adjacent the top edge of the cup and said strap means extends from a point adjacent the end of said arcuate extension to said securing ring.

* * * * *